US012168501B2

(12) United States Patent
Richter et al.

(10) Patent No.: US 12,168,501 B2
(45) Date of Patent: Dec. 17, 2024

(54) BUOYANCY MODIFICATION MODULE FOR A MODULAR UNDERWATER VEHICLE

(71) Applicants: thyssenkrupp Marine Systems GmbH, Kiel (DE); thyssenkrupp AG, Essen (DE)

(72) Inventors: Nicolas Richter, Klein Offenseth-Sparrieshoop (DE); Sascha Nehren, Schoenkirchen (DE); Andreas Jess, Plön (DE); Thomas Voss, Süsel-OT Middelburg (DE); Willem Hendrik Wehner, Jübek (DE); Marc Schiemann, Kiel (DE)

(73) Assignees: thyssenkrupp Marine Systems GmbH, Kiel (DE); thyssenkrupp AG, Essen (DE)

( * ) Notice: Subject to any disclaimer, the term of this patent is extended or adjusted under 35 U.S.C. 154(b) by 694 days.

(21) Appl. No.: 17/413,657

(22) PCT Filed: Feb. 10, 2020

(86) PCT No.: PCT/EP2020/053261
§ 371 (c)(1),
(2) Date: Jan. 19, 2022

(87) PCT Pub. No.: WO2020/169376
PCT Pub. Date: Aug. 27, 2020

(65) Prior Publication Data

US 2022/0144397 A1 May 12, 2022

(30) Foreign Application Priority Data

Feb. 19, 2019 (DE) ..... 10 2019 202 189

(51) Int. Cl.
*B63G 8/22* (2006.01)
*B63G 8/00* (2006.01)

(52) U.S. Cl.
CPC ..... *B63G 8/22* (2013.01); *B63G 8/001* (2013.01); *B63G 2008/004* (2013.01)

(58) Field of Classification Search
CPC . B63G 8/00; B63G 8/001; B63G 8/14; B63G 8/22; B63G 2008/004
(Continued)

(56) References Cited

U.S. PATENT DOCUMENTS

| | | | | |
|---|---|---|---|---|
| 9,315,248 | B2 | 4/2016 | Williams | |
| 10,272,980 | B2 * | 4/2019 | Abdellatif | G01N 29/041 |
| 11,220,316 | B2 * | 1/2022 | Mahmoudian | B63C 11/52 |

FOREIGN PATENT DOCUMENTS

| | | |
|---|---|---|
| CN | 107 618 643 A | 1/2018 |
| CN | 107 804 442 A | 3/2018 |

(Continued)

OTHER PUBLICATIONS

English Translation of International Search Report issued in PCT/EP2020/053261, dated Apr. 3, 2020.

(Continued)

*Primary Examiner* — Daniel V Venne
(74) *Attorney, Agent, or Firm* — thyssenkrupp North America, LLC

(57) ABSTRACT

A buoyancy modification module for a modular underwater vehicle may include a first frame configured to connect the buoyancy modification module to other modules, and a first pressure hull with a first flooding region and a first dry region. A first pump arranged in the first dry region can pump water out of the surroundings or a neutral-buoyancy reservoir into the first flooding region and out of the first flooding region into the surroundings or the neutral-buoyancy reservoir. A first gas region that is connected to the first flooding region may include a first gas pressure when the first flooding region is completely empty, and a second gas (Continued)

pressure when the first flooding region is completely flooded. A difference between the first gas pressure and the second gas pressure results from a reduction in space available for gas in the first gas region.

20 Claims, 2 Drawing Sheets

(58) Field of Classification Search
USPC ..... 114/312, 313, 317, 331, 333
See application file for complete search history.

(56) References Cited

FOREIGN PATENT DOCUMENTS

| | | | |
|---|---|---|---|
| CN | 107918643 | A | 4/2018 |
| DE | 10 2010 047 677 | A | 4/2012 |
| DE | 10 2017 200 078 | A | 7/2018 |
| EP | 0 850 830 | A2 | 7/1998 |
| GB | 2 351 718 | A | 1/2001 |
| JP | 63129693 | U | 8/1988 |
| JP | 10086894 | A | 5/1994 |
| JP | 2009 096396 | A | 5/2009 |
| NO | 160190 | B | 12/1988 |
| WO | 2009/008880 | A | 1/2009 |
| WO | 2016/026894 | A | 2/2016 |

OTHER PUBLICATIONS

Jensen, Harold Franklin, "Variable buoynacy system metric", (Jun. 2009), DOI: 10.1575/1912/3033, https://hdl.handle.net/1912/3033.
Smarter Subsea Handling: Controllable buoyancy solutions for transforming subsea development and operations of the offshore energy sector, Deep Sea Recovery Limited, https://www.deepsearecovery.co.uk/ (Accessed Aug. 2018).
Aras M. S. M., et al., "Auto Depth Control for Underwater Remotely Operated Vehicles using a Flexible Ballast Tank System", Journal of Telecommunication, Electronic and Computer Engineering, vol. 7, No. 1, 8 pages (Jun. 2015).

* cited by examiner

BUOYANCY MODIFICATION MODULE FOR A MODULAR UNDERWATER VEHICLE

CROSS REFERENCE TO RELATED APPLICATIONS

This application is a U.S. National Stage Entry of International Patent Application Serial Number PCT/EP2020/053261, filed Feb. 10, 2020, which claims priority to German Patent Application No. DE 10 2019 202 189.1, filed Feb. 19, 2019, the entire contents of both of which are incorporated herein by reference.

FIELD

The present disclosure generally relates to underwater vehicles, including buoyancy modification modules for modular underwater vehicles.

BACKGROUND

Modular water vehicles are customarily assembled according to the typical mission profile and consist of various modules which assume different functions. The various modules in this case are connected to one another in a similar way to standard containers. For this purpose, the modules usually have standardized external dimensions and connecting elements. The nature and number of the modules can therefore easily be selected and connected by simple connection, depending on the mission profile involved, to create an underwater vehicle.

In a mission scenario, the mass and therefore the buoyancy of the modular water vehicle can change during said mission. For example, the modular water vehicle may pick up objects, for example rock samples, measuring devices, raw materials, waste and much more besides. Alternatively or in addition, the modular water vehicle may drop off objects, such as measuring devices, consumables (for example fuel to an underwater facility), smaller autonomous underwater vehicles and much more besides.

Buoyancy within the meaning of the invention may be positive or negative. Negative buoyancy is also referred to as downforce.

A modular water vehicle having at least one useful element and two first bow elements is known from DE 10 2017 200 078 A1.

WO 2016/026894 A1 discloses a method for controlling a buoyancy control device.

GB 2 351 718 A discloses a buoyancy control system.

A submarine having a plurality of pressure hulls is known from EP 0 850 830 A2.

A modular system for producing underwater robots is known from U.S. Pat. No. 9,315,248 B2.

A device for pressing on a buoyancy tank is known from DE 10 2010 047 677 A1.

A configurable underwater vehicle is known from WO 2009/008880 A1.

Thus, a need exists for a module with which the buoyancy of a modular underwater vehicle can be modified, in order to compensate for the pick-up or drop-off of objects.

DETAILED DESCRIPTION

Figure 1:
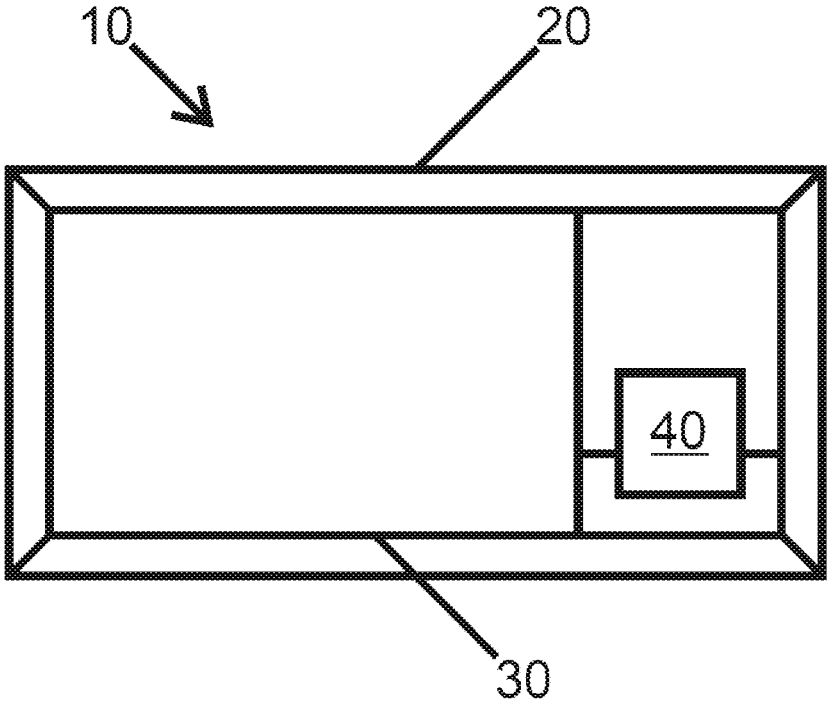
FIG. 1 is a schematic view of an example first non-flooded buoyancy modification module.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

In some embodiments, a buoyancy modification module for a modular underwater vehicle is configured to be flushed with water and comprises a first frame configured to connect the buoyancy modification module to other buoyancy modification modules, wherein the first frame is arranged in a shape comprising edges of a right prism, a first pressure hull with a first flooding region, and a first pump configured to pump water from surroundings or from a neutral-buoyancy reservoir into the first flooding region and configured to pump water out of the first flooding region into the surroundings or the neutral-buoyancy reservoir. In some embodiments, the first frame includes a framework arranged in a shape comprising edges of a cuboid. In some embodiments, the first frame is not a pressure hull.

The buoyancy modification module according to the invention for a modular underwater vehicle has at least one first frame, wherein the frame is designed to connect the buoyancy modification module to other modules. The buoyancy modification module is flushed through with water. Consequently, any unused spaces in the buoyancy modification module have neutral buoyancy. Furthermore, the entire module need not be configured as a pressure hull, which would be problematic; instead, a simple combination of modules, for example a cuboid basic shape of the module, is optimal, which, however, is not optimal for a pressure hull. In the simplest case, the frame may actually be configured as a framework in the form of the edges of a cube. This enables the modules to be easily connected in all three spatial directions.

The buoyancy modification module has at least one first pressure hull, wherein the first pressure hull has at least one first flooding region. At least one first pump is arranged in the buoyancy modification module, wherein the first pump can pump water out of the surroundings or a neutral-buoyancy reservoir into the first flooding region, and out of the first flooding region into the surroundings or a neutral-buoyancy reservoir.

If the first pump pumps water out of the surroundings, the system is comparatively simple. However, it is disadvantageous that the pump itself, and also the first flooding region, are thereby exposed to the effects of the surrounding water. Impurities, corrosion and fouling are particularly relevant.

If the first pump pumps water into and out of a neutral-buoyancy reservoir, then clean water can be used. A neutral-buoyancy reservoir can be designed in the shape of a balloon, for example. However, this changes the volume. Moreover, the elastic materials used for this purpose age comparatively quickly, thereby increasing the risk of failure. The space requirement must also be taken into account in the construction.

In a further embodiment of the invention, the frame has a basic shape which corresponds to a right prism with a regular quadrilateral as the base. For example and in particular, the frame has a cuboidal basic shape, wherein a cube is a right prism with a square as the base. In this way, the modules can be optimally combined, both in relation to stability and also utilization of space.

In a further embodiment of the invention, the first pressure hull has at least one first dry region, wherein the at least one first pump is arranged in the first dry region.

The arrangement of the first pump in the first dry region inside the first pressure hull enables a simpler pump to be used which is not exposed either to the surrounding water or to the ambient pressure and the changing ambient conditions resulting from this.

In a further embodiment of the invention, the buoyancy modification module has at least one first gas region, wherein the first gas region is connected to the first flooding region.

In principle, it is possible for the gas present in the first flooding region to be expelled during each dive and reintroduced from a pressure reserve during emptying. However, this is problematic in the case of underwater vehicles which either need to advance to great depths, for example 2000 m, or are intended to perform a relatively large number of dives or depth changes. Since conventional gas cylinders operate at a pressure of 300 bar, in particular, this means that at a depth of 2000 m a gas cylinder volume that is many times greater has to be carried along for each dive in proportion to the first flooding region. It is therefore advantageous for gas located in the first flooding region to be compressed when the first gas region is flooded. This means that although the first pump works against the rising pressure, the gas volume need not be made available again when it once again rises.

In a further embodiment of the invention, the first gas region has a first gas pressure when the first flooding region is completely empty. Furthermore, when the first flooding region is completely flooded, the first gas region has a second gas pressure. The difference between the first gas pressure and the second gas pressure results from the reduction in the space available for the gas in the first gas region.

In the simplest case, the first flooding region and the first gas region form a common space. So if, for example, the first flooding region accounts for ⅔ of this common space and the first gas region ⅓, said common space is flooded to at most ⅔. As a first approximation (ideal gas law), the gas pressure between the emptied state and the flooded state would triple as a result of this. In this case, the separation between the first flooding region and the gas region may take place purely in terms of control technology, for example by changing the pressure in the inside.

In a further embodiment of the invention, the buoyancy modification module has at least one second gas region, wherein the first gas region and the second gas region are connected to one another in a gas-conveying manner. By way of example and preferably, the first gas region is arranged in the first pressure hull and the second gas region outside the first pressure hull. By way of example and in particular, the second gas region is arranged in a second pressure hull. Particularly preferably, the second pressure hull forms the second gas region. By way of example and preferably, the second pressure hull is a pressurized gas cylinder. By way of example and in particular, the buoyancy modification module may also have more than one second gas region. By way of example and preferably, two, three, four, six, eight or ten standard commercial gas pressure cylinders may form two gas regions.

In a further embodiment of the invention, the first gas region and the second gas region are connected via a first gas pump. Without a gas pump, the resulting gas pressure comes from the reduction or increase in the available volume. A pressure difference can be generated by a gas pump. In addition, the pressure acting against the first pump can be reduced during flooding in order to save power there. However, the disadvantage is the increased complexity of the system.

In a further embodiment of the invention, the first gas region and the second gas region are connected via a first valve, wherein the first valve prevents the penetration of liquid into the second gas region. For example, the first valve is a non-return valve or another one-way valve.

In a further embodiment of the invention, the first gas region has a first gas pressure when the first gas region is completely emptied, wherein the first gas pressure corresponds to half the maximum dive pressure. This pressure has proved optimal in keeping the output of the first pump at the lowest possible level and thereby conserving energy.

In a further embodiment of the invention, the first gas region has a second gas pressure when the first flooding region is completely flooded, wherein the second gas pressure corresponds to 1.5 times the maximum dive pressure. This pressure has proved optimal in keeping the output of the first pump at the lowest possible level and thereby conserving energy.

Particularly preferably, the first gas region has a first gas pressure when the first flooding region is completely emptied, the first gas pressure corresponding to half the maximum dive pressure and, when the first flooding region is completely flooded, a second gas pressure, wherein the second gas pressure corresponds to 1.5 times the maximum dive pressure. This combination has proved optimal in keeping the output of the first pump at the lowest possible level and thereby conserving energy.

In a further embodiment of the invention, the first gas region and the first dry region are connected to one another in a gas-conveying manner. In this way, the volume surrounding the first pump can be used. At the same time, the first pump remains dry. Consequently, a slightly more compact design is possible. A valve which prevents the penetration of water into the first dry region is preferably arranged between the first gas region and the first dry region.

In a further embodiment of the invention, the first gas region and the first flooding region are separated from one another by a movable, liquid-tight layer. A movable, liquid-tight layer—a film, for example—can prevent water from being able to reach the first gas region. This can also be used to prevent gas from the first gas region from being released into the surroundings by the first pump.

In a further embodiment of the invention, the first pump is selected from the group comprising a diaphragm pump, plunger pump, rotary vane pump. The first pump is preferably a plunger pump.

In a further embodiment of the invention, the buoyancy modification module has a second pump, wherein the first pump and the second pump are connected in parallel. Particularly preferably, the first pump and the second pump have a common drive. More preferably, the buoyancy modification module has a third pump, wherein the first pump, the second pump and the third pump are connected in parallel. Particularly preferably, the first pump, the second pump and the third pump have a common drive.

In a further embodiment of the invention, the buoyancy modification module has the external dimensions 2991 mm by 2438 mm by 2438 mm.

In a further aspect, the invention relates to a modular underwater vehicle. The modular underwater vehicle is composed of at least three modules. At least one module is a first buoyancy modification module according to the invention.

In a further embodiment of the invention, the modules have a basic shape which corresponds to a right prism with a regular quadrilateral as the base. For example and in particular, the modules have a cuboidal basic shape, wherein a cuboid is a right prism with a square as the base. In this way, the modules can be optimally combined, both in relation to stability and also utilization of space. In this case, there is no need for all modules to be an identical shape. For example, all modules have the same base, meaning that they can easily be arranged behind one another in a row. The length in this case may differ between the modules. Likewise, modules may have different bases, by way of example and in particular, a module may have a base which is twice as large as that of another module, as a result of which this module can be combined with two other modules arranged alongside one another. In particular, the foremost and the rearmost module have a shape which substantially differs from this, so that the bow and the stern of the underwater vehicle have a streamlined design. All that is required in each case is for the base to be compatible with that of the module immediately adjacent.

In a further embodiment of the invention, the first buoyancy modification module is mechanically connected to all adjacent modules. Furthermore, the first buoyancy modification module has an electrical connection to at least one adjacent module. The first buoyancy modification module preferably has a data connection to at least one adjacent module.

In a further embodiment of the invention, the modular underwater vehicle has a first payload module. The first buoyancy modification module and the first payload module are preferably adjacent. This is advantageous, since the first payload module can change the mass of the modular underwater vehicle when a payload is dropped off or picked up. Therefore, the closer the first buoyancy modification module is, the smaller the change in the trim of the modular underwater vehicle.

In a further embodiment of the invention, the modular underwater vehicle has a second buoyancy modification module, wherein the first buoyancy modification module is adjacent to the first payload module at the bow end and the second buoyancy modification module is adjacent to the first payload module at the stern end. This symmetrical arrangement allows the trim to be kept particularly stable.

Figure 2:
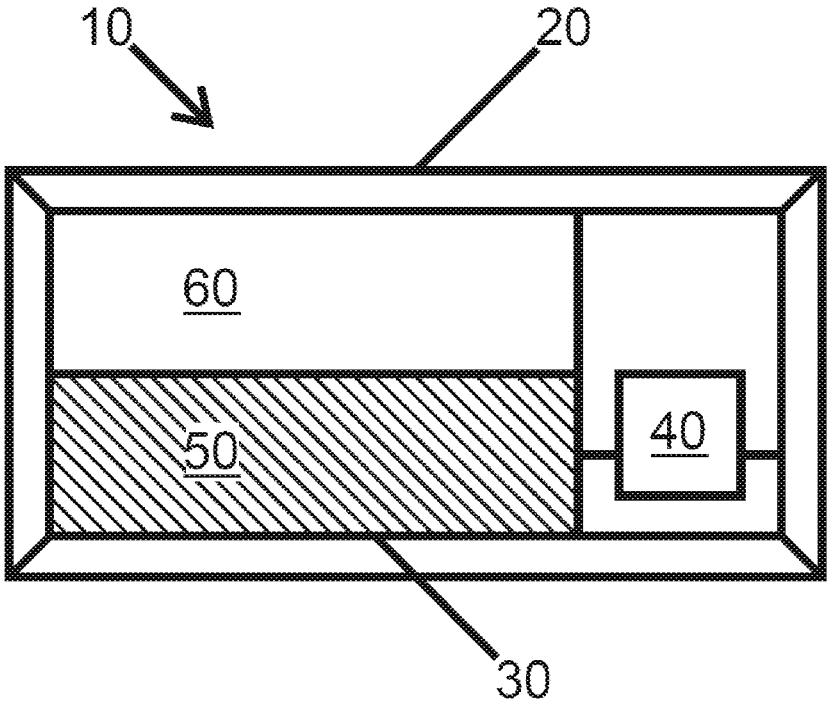
FIG. 2 is a schematic view of a first flooded buoyancy modification module.

FIG. 1 shows a first buoyancy modification module 10 in the non-flooded state and FIG. 2 shows it in the flooded state. The buoyancy modification module 10 has a frame 20 and a first pressure hull 30 connected to the frame 20. The inside of the first pressure hull 30 is divided into two regions. There is a first dry region on the right, in which the first pump 40 is located. With the help of the first pump 40, water can be pumped out of the surroundings into the left region of the pressure hull 30 or in the opposite direction. The left region is divided into a first flooding region 50, which is provided for flooding with water, and a first gas region 60, in which a gas, in particular air or nitrogen, is located.

Figure 3:
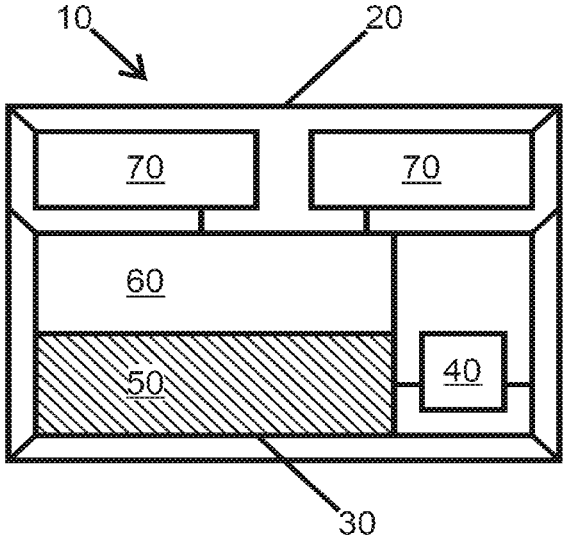
FIG. 3 is a schematic view of a second example flooded buoyancy modification module with a second gas region.

FIG. 3 shows a second buoyancy modification module 10 which has, in addition, two second gas regions 70 which are connected to the first gas region 60. The second gas regions 70 preferably take the shape of standard commercial pressurized gas cylinders. The advantage is that these can be effectively arranged alongside the customarily cylindrical first pressure hull 30 utilizing the space available in the frame. Furthermore, these are standard commercial and therefore comparatively inexpensive components.

Figure 4:
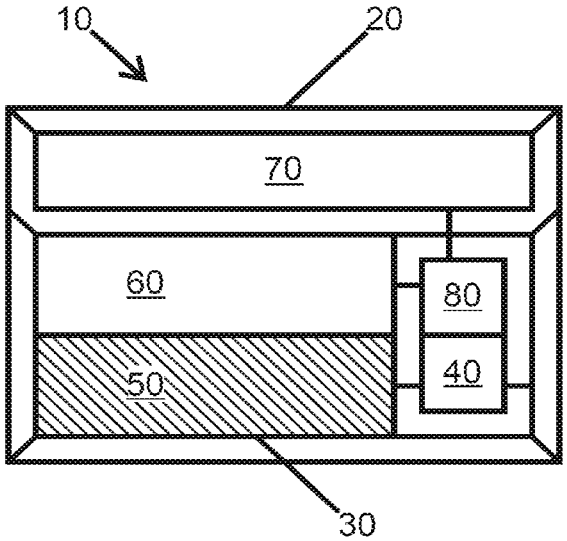
FIG. 4 is a schematic view of a third example flooded buoyancy modification module with a gas pump.

The third buoyancy modification module 10 shown in FIG. 4 has, in addition, a gas pump 80 via which gas can be conveyed from the first gas region 60 into the second gas region 70 and back.

Figure 5:
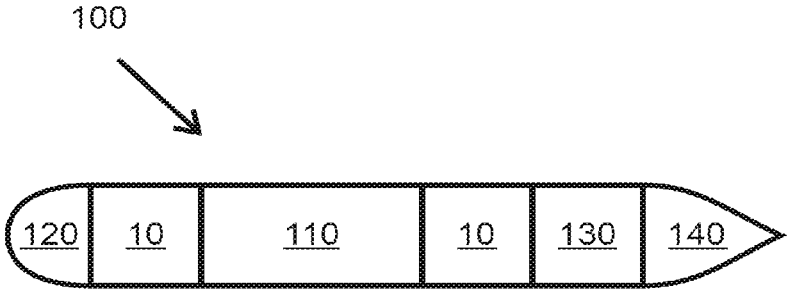
FIG. 5 is a schematic view of an example modular underwater vehicle.

FIG. 5 shows an exemplary modular underwater vehicle 100. The modular underwater vehicle 100 has a first payload module 110. In order to compensate for the change in mass of the payload module 110 during the mission, a buoyancy modification module 10 is arranged in front of and behind the payload module 110 in each case. For example, the modular underwater vehicle 100 also has a bow module 120 which may have sonar and control electronics, for example. An energy module 130 is arranged at the stern. This may comprise a storage battery, a fuel cell and/or a diesel engine independent of the outside air. All other modules are supplied with energy by the energy module 130. Furthermore, the modular underwater vehicle 100 has a stern module 140 which comprises, for example, the drive motor and a propeller and also the rudder.

LIST OF REFERENCE NUMBERS

10 buoyancy modification module
20 frame
30 first pressure hull
40 first pump
50 first flood region
60 first gas region
70 second gas region
80 gas pump
100 modular underwater vehicle
110 payload module
120 bow module
130 energy module
140 stern module

What is claimed is:

1. A buoyancy modification module for a modular underwater vehicle, with the buoyancy modification module being configured to be flushed with water, the buoyancy modification module comprising:

a first frame configured to connect the buoyancy modification module to other buoyancy modification modules, wherein the first frame is arranged in a shape comprising edges of a right prism;

a first pressure hull with a first flooding region; and a first pump configured to pump water from surroundings or from a neutral-buoyancy reservoir into the first flooding region and configured to pump water out of the first flooding region into the surroundings or the neutral-buoyancy reservoir.

2. The buoyancy modification module of claim 1 wherein the first pressure hull includes a first dry region in which the first pump is disposed.

3. The buoyancy modification module of claim 1 comprising a first gas region that is connected to the first flooding region.

4. The buoyancy modification module of claim 3 wherein the first gas region includes a first gas pressure when the first flooding region is completely empty, wherein when the first flooding region is completely flooded the first gas region has a second gas pressure, wherein a difference between the first gas pressure and the second gas pressure results from a reduction in space available for gas in the first gas region.

5. The buoyancy modification module of claim 4 comprising a second gas region, with the first and second gas regions being connected in a gas-conveying manner.

6. The buoyancy modification module of claim 5 wherein the first gas region is disposed in the first pressure hull and the second gas region is disposed outside the first pressure hull.

7. The buoyancy modification module of claim 6 wherein the second gas region is disposed in a second pressure hull.

8. The buoyancy modification module of claim 5 wherein the first and second gas regions are connected via a first valve that prevents penetration of liquid into the second gas region.

9. The buoyancy modification module of claim 3 wherein the first gas region has a first gas pressure when the first flooding region is completely empty, wherein the first gas pressure corresponds to half of a maximum dive pressure.

10. The buoyancy modification module of claim 9 wherein the first gas region has a second gas pressure when the first flooding region is completely flooded, wherein the second gas pressure corresponds to 1.5 times the maximum dive pressure.

11. The buoyancy modification module of claim 1 wherein the first pressure hull includes a first dry region in which the first pump is disposed, wherein the buoyancy modification module comprises a first gas region that is connected to the first flooding region, wherein the first gas region and the first dry region are connected in a gas-conveying manner.

12. The buoyancy modification module of claim 3 wherein the first gas region and the first flooding region are separated by a movable, liquid-tight layer.

13. A modular underwater vehicle comprising at least three modules, wherein at least one of the at least three modules is the buoyancy modification module of claim 1.

14. The modular underwater vehicle of claim 13 wherein the buoyancy modification module is mechanically connected to all adjacent modules of the at least three modules, wherein the buoyancy modification module includes an electrical connection to at least one adjacent module of the at least three modules.

15. The modular underwater vehicle of claim 13 comprising a first payload module that is adjacent to the buoyancy modification module.

16. The modular underwater vehicle of claim 15 wherein the buoyancy modification module is a first buoyancy modification module, the modular underwater vehicle comprising a second buoyancy modification module, wherein the first buoyancy modification module is adjacent to the first payload module at a bow end, wherein the second buoyancy modification module is adjacent to the first payload module at a stern end.

17. The buoyancy modification module of claim 1 wherein the first frame includes a framework arranged in a shape comprising edges of a cuboid.

18. The buoyancy modification module of claim 1 wherein the first frame is not a pressure hull.

19. A buoyancy modification module for a modular underwater vehicle, with the buoyancy modification module being configured to be flushed with water, the buoyancy modification module comprising:

a first frame configured to connect the buoyancy modification module to other buoyancy modification modules;

a first pressure bull with a first flooding region;

a first pump configured to pump water from surroundings or from a neutral-buoyancy reservoir into the first flooding region and configured to pump water out of the first flooding region into the surroundings or the neutral-buoyancy reservoir; and a first gas region that is connected to the first flooding region, wherein the first gas region has a first gas pressure when the first flooding region is completely empty, wherein the first gas pressure corresponds to half of a maximum dive pressure.

20. The buoyancy modification module of claim 19 wherein the first gas region has a second gas pressure when the first flooding region is completely flooded, wherein the second gas pressure corresponds to 1.5 times the maximum dive pressure.

* * * * *